US009347465B2

(12) United States Patent
González

(10) Patent No.: US 9,347,465 B2
(45) Date of Patent: May 24, 2016

(54) FAN GUARD FOR AIR CONDITIONING MACHINE

(71) Applicant: Plasticos y Alambres, S.A. DE C.V., García, Nuevo León, C.P. (MX)

(72) Inventor: Ricardo Cantú González, San Pedro Garza García (MX)

(73) Assignee: Plasticos Y Alambres S.A. DE C.V., Garcia, Nuevo Leon (MX)

( * ) Notice: Subject to any disclaimer, the term of this patent is extended or adjusted under 35 U.S.C. 154(b) by 566 days.

(21) Appl. No.: 13/916,405

(22) Filed: Jun. 12, 2013

(65) Prior Publication Data

US 2014/0154095 A1 Jun. 5, 2014

(30) Foreign Application Priority Data

Nov. 30, 2012 (MX) ..... MX/A/2012/013974

(51) Int. Cl.

| | |
|---|---|
| ***F24F 1/56*** | (2011.01) |
| ***F04D 29/70*** | (2006.01) |
| ***F24F 1/06*** | (2011.01) |
| ***F24F 1/38*** | (2011.01) |
| ***F24F 1/50*** | (2011.01) |

(52) U.S. Cl.

CPC ..... *F04D 29/703* (2013.01); *F24F 1/06* (2013.01); *F24F 1/38* (2013.01); *F24F 1/50* (2013.01); *F24F 1/56* (2013.01)

(58) Field of Classification Search

CPC ..... F24F 13/082; F24F 1/56; F24F 1/50; F24F 1/38; F24F 1/06; F24F 1/58; F04D 29/703; Y10T 74/219

See application file for complete search history.

(56) References Cited

U.S. PATENT DOCUMENTS

| | | | | | |
|---|---|---|---|---|---|
| 1,114,459 | A | * | 10/1914 | Fritts | F04D 29/703 416/247 R |
| 2,498,968 | A | * | 2/1950 | Viewegh | F04D 29/703 416/247 R |
| 2,656,974 | A | * | 10/1953 | Holstein | F04D 29/703 416/244 R |
| 2,829,819 | A | * | 4/1958 | Corwin | F04D 29/703 416/247 R |
| 2,987,242 | A | * | 6/1961 | Mazzacane | F04D 29/703 416/247 R |
| 3,123,288 | A | * | 3/1964 | Franklin | F04D 29/703 415/121.2 |
| 3,865,517 | A | * | 2/1975 | Simmons | F25B 39/04 165/122 |
| 4,818,183 | A | * | 4/1989 | Schaefer | F04D 29/70 416/247 R |
| 5,002,462 | A | * | 3/1991 | Janisse | F04D 29/703 403/338 |

(Continued)

*Primary Examiner* — Richard Edgar
*Assistant Examiner* — Eldon Brockman
(74) *Attorney, Agent, or Firm* — Frommer Lawrence & Haug LLP; A. Thomas S. Safford

(57) ABSTRACT

A fan guard for a condenser unit of an air conditioner which supports the fan motor made of wire formed into a plurality of concentric rings or rectangles, or a spiral, secured to a spaced plurality of first radially-oriented elements each having at its peripherally-positioned end an orifice for fastening the guard to the unit and to an interspaced plurality of second radially-oriented elements each having at its end, closest to the fan guard's center, an orifice for fastening the motor to the guard, a third element extending all across the guard, and a sturdy ring affixed to at least the first and second elements proximate to the center. The guard preferably is convex whose wire elements have an elongated cross-sectional shape with lower airflow resistance. The fan guard has low fabrication and materials costs and allows use of motors with lower energy consumption for the same airflow efficiency.

20 Claims, 6 Drawing Sheets

(56) References Cited

U.S. PATENT DOCUMENTS

| | | | | |
|---|---|---|---|---|
| 5,097,678 | A | 3/1992 | Aubuchon | |
| 5,480,282 | A * | 1/1996 | Matson | F04D 25/105 415/125 |
| 6,036,444 | A * | 3/2000 | Barney | F04D 29/703 415/121.2 |
| 6,503,060 | B1 * | 1/2003 | Kamada | F04D 29/542 415/121.2 |
| 6,726,734 | B2 * | 4/2004 | Bayer | A01D 34/828 55/297 |
| 6,866,474 | B2 | 3/2005 | Uselton | |
| 7,690,888 | B2 * | 4/2010 | Garnett | F04D 29/703 415/121.2 |
| 8,191,381 | B2 | 6/2012 | Kim et al. | |
| 9,080,580 | B2 * | 7/2015 | Heli | F04D 29/626 |
| 2008/0092576 | A1 * | 4/2008 | Hoffman | F24F 1/50 62/259.1 |

* cited by examiner

FAN GUARD FOR AIR CONDITIONING MACHINE

FIELD OF THE INVENTION

The present invention relates to a fan guard preferably made of steel wire for covering and protecting a fan for circulating air in the outdoor unit of an split air conditioner, which guard additionally to its main function of preventing damage to the fan and safe operation of the air conditioning unit, supports the weight and rotation load of the fan motor. The construction of the protecting guard provides a number of advantages as strong mechanical support for the motor and a minimum obstruction to airflow across said air conditioning outdoor unit.

BACKGROUND OF THE INVENTION

Air conditioners of the split or mini-split unit type for residential or office spaces have become extensively used. Such air conditioners have two separate units: a refrigerant fluid evaporation unit installed inside the room being cooled or heated (where heat is exchanged between the inside air and the refrigerant fluid), and a condenser unit located outside the air conditioned room (where heat is dissipated from the refrigerant fluid to the outside atmospheric air).

Heat is transferred to the outside air by inducing circulation of air through a finned coil by means of a fan. There are many designs and structures of these condensing units. A widely utilized design of the exterior condenser units comprises a cabinet with lateral walls open to the passage of ambient air through the enclosed finned heat-transfer coil, the compressor, and other components of the condenser unit of the air conditioning system, and a top air outlet through which a fan, having a horizontal plane of rotation located at the upper part of said cabinet, forces a generally upward flow of air from across the lateral walls.

Usually the motor of the fan is located centrally in respect to a circular outlet at the upper cover of the cabinet. The fan motor normally is secured to the cabinet by means of a plurality of supporting elements.

The air outlet is protected by a cover, which permits the passage of air while obstructing fingers and most objects of that size and larger from passing in to reach the fan blades. This fan guard may be made for example of steel sheet with perforations or of steel wire formed in spaced-apart concentric circles or in a spaced-apart spiral winding in cooperation with radial supporting elements. The design and structure of this fan guard must comply with the safety standards; yet it must offer a minimum resistance to the air flow in order to increase the heat-transfer efficiency and have less energy consumption by the driving motor.

The fan guards made of steel wire that are normally utilized may have a central plate made of steel sheet (dish) which provides mechanical strength to the guard and rarely may provide a solid base for fastening the fan motor by means of screws or any other suitable fasteners There is an unsatisfied need in the air conditioning units market for a fan guard of low cost, which also has the suitable mechanical strength for better supporting weight and rotational forces of the fan motor and which meets the safety norms regarding the spacing of the elements forming the guard and also offers a low resistance to air flow across said guard in order to decrease the capacity and energy consumption of said motor.

U.S. Pat. No. 3,865,517 to Simmonds et al describes an air conditioning split apparatus wherein the outside unit has an upper air outlet and a guard covering said outlet for protecting the motor and the fan. The guard is formed by concentric rings fastened to a plurality of radial elements in a manner not disclosed by this patent, since the drawings show a gap between the radial elements and the rings constituting the guard. The fan motor is supported by said radial elements that bend towards the inner part of the air conditioning apparatus supporting said fan motor at the sides part of its housing. Though this patent mentions that the central plate 29 is used for esthetic purposes and for protection of the motor, it is inferred that said plate also cooperates significantly to increase the mechanical strength of the guard because the radial elements 15 pass through said plate thus forming a unitary structure.

U.S. Pat. No. 6,866,474 to Aubuchon describes an impervious protective cover (preferably of a heavy vinyl cloth) to be used on the upper part of an air conditioner condenser unit when not in use for an extended time period, which cover is shaped to extend downwardly to at least the plane of rotation of the horizontal fan blades, but preferably not more than half way (so as to accumulation of most debris while not trapping excess moisture). The fan motor 46 is incidentally shown to be mounted on the underside of a central plate 29 of the top outlet grill.

U.S. Pat. No. 6,866,474 to Uselton shows a fan guard 40 for an air conditioning system having a top air outlet 38 and a fan guard 40. This patent clearly shows in FIGS. 1 and 3 that the motor 32 and fan 26 are secured well below and entirely apart from the fan guard 40 by means of laterally projecting supporting members 34. As shown in FIG. 3, the guard design comprises a plurality of radial elements 44, 46 a plurality of circular or spiral elements 50, 32 and a central disk shaped hub 42, but this guard is not intended for supporting the fan motor.

U.S. Pat. No. 8,191,381 to Kim et al. discloses an outdoor fan for an air-conditioning unit with some characteristics that allow for a reduced energy-consumption and reduced noise during its operation. FIG. 2 shows a fan guard made of what appears to be concentric wire elements but the fan motor (10, 110) being positioned below the fan (40, 140) as indicated in FIG. 1 clearly would not be in a position to be supported by the fan guard (there being no illustration nor description of how the fan motor is supported).

No fan guard incorporating all the features and advantages of the invention was found in the prior art.

OBJECTS OF THE INVENTION

It is therefore an object of the invention to provide a fan guard for air conditioning units of a simplified construction and low fabrication costs.

It is another object of the invention to provide a fan guard made of steel wire for air conditioning units, which additionally to being of easy fabrication, also offers a lower resistance to the air flow across the guard and therefore permits using motors of lower energy consumption.

DETAILED DESCRIPTION OF THE INVENTION

Some preferred embodiments of the invention are here described with reference to the accompanying drawings wherein like numerals designate like elements to facilitate reading and understanding of the invention.

Figure 1:
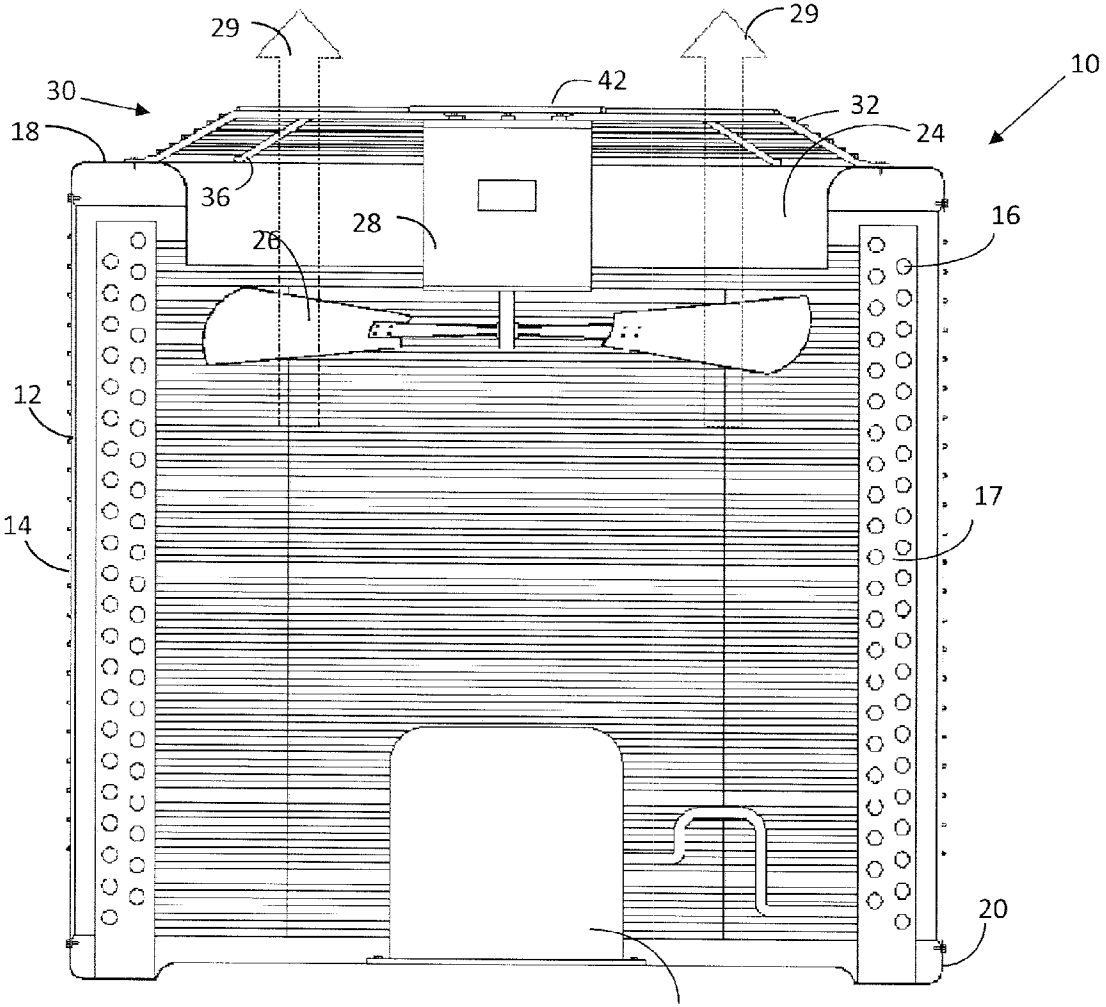
FIG. 1 is a schematic partially-sectioned lateral view of an outside condenser unit of an air conditioner showing a preferred general arrangement thereof and a preferred manner of installing an illustrated preferred embodiment of the fan guard of the invention.

With reference to FIG. 1, a schematic lateral view of the outside unit 10 of a split air conditioning apparatus for commercial or residential use, also called a condenser 10 because in this unit 10 the heat extracted from the inner space of a room or office is transferred to the outside atmospheric air by condensing the refrigerating fluid, which is then recycled as a liquid to the inside unit of the air conditioning apparatus, after its compression, to absorb more heat through its evaporation.

The outside condenser unit 10 of the air conditioning apparatus comprises a cabinet 12, having lateral walls with openings as air inlets 14 through which the air circulates across the inside of the cabinet in contact with the coil pipe 16 that usually is formed in the form of a serpentine fixed close to the cabinet walls by means of suitable supports 17 so that the air stream has a good contact with said coil pipe 16. The cabinet 12 has an upper cover 18 and a base 20 to which normally a compressor 22 is fixed.

The upper cover 18 has an air outlet 24. A fan 26 driven by a motor 28 induces an air flow 29 up through outlet 24 that originates from the air inlets 14 in the lateral walls of the cabinet 12.

The guard 30 covers the outlet 24 for protection of the users of the air conditioning unit against potential accidents by contact with fan 26 and for preventing objects from falling into the inside of the cabinet that may damage the fan 26. The fan 26 preferably rotates on a horizontal plane but it may also be oriented in a vertical plane with an air outlet located in a lateral wall of cabinet 12.

In currently marketed air conditioning apparatus, the fan motor is secured to the cabinet by metallic supporting elements independent from the fan guard, or in some cases fan guards made of steel wire are used which hold and support the motor, but which comprise a metallic plate, generally of circular shape, located at the center of the guard, to provide the necessary mechanical strength, wherein the radial metallic elements forming the guard are welded. This central plate provides a firm base for supporting the weight and other forces caused by the fan operation, to which the motor is fastened.

The present invention provides a simplified design and construction of the guards, eliminating the need of a central plate, whereby the fabrication cost of the guards is lower thus rendering economic advantages.

Figure 3:
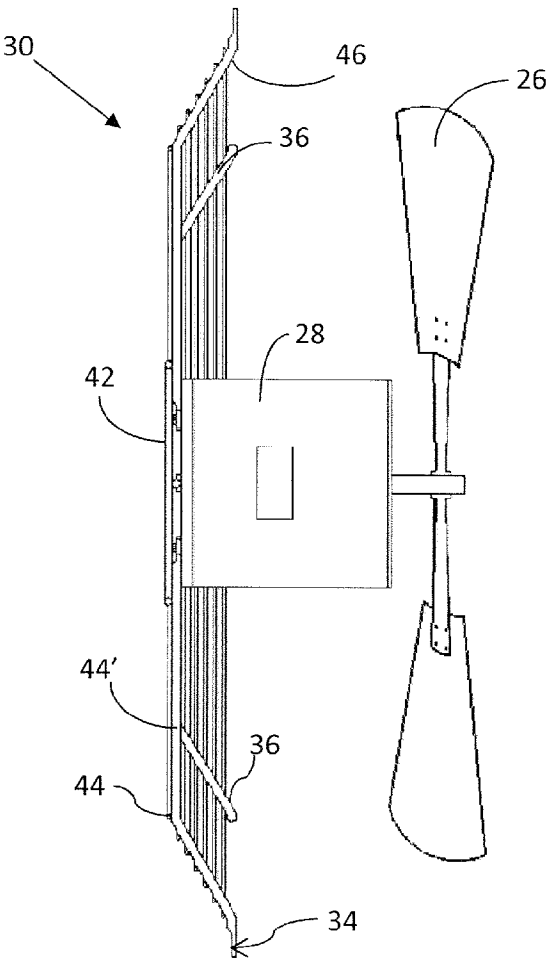
FIG. 3 shows a schematic lateral view of the fan guard and motor shown in FIG. 2.
Figure 2:
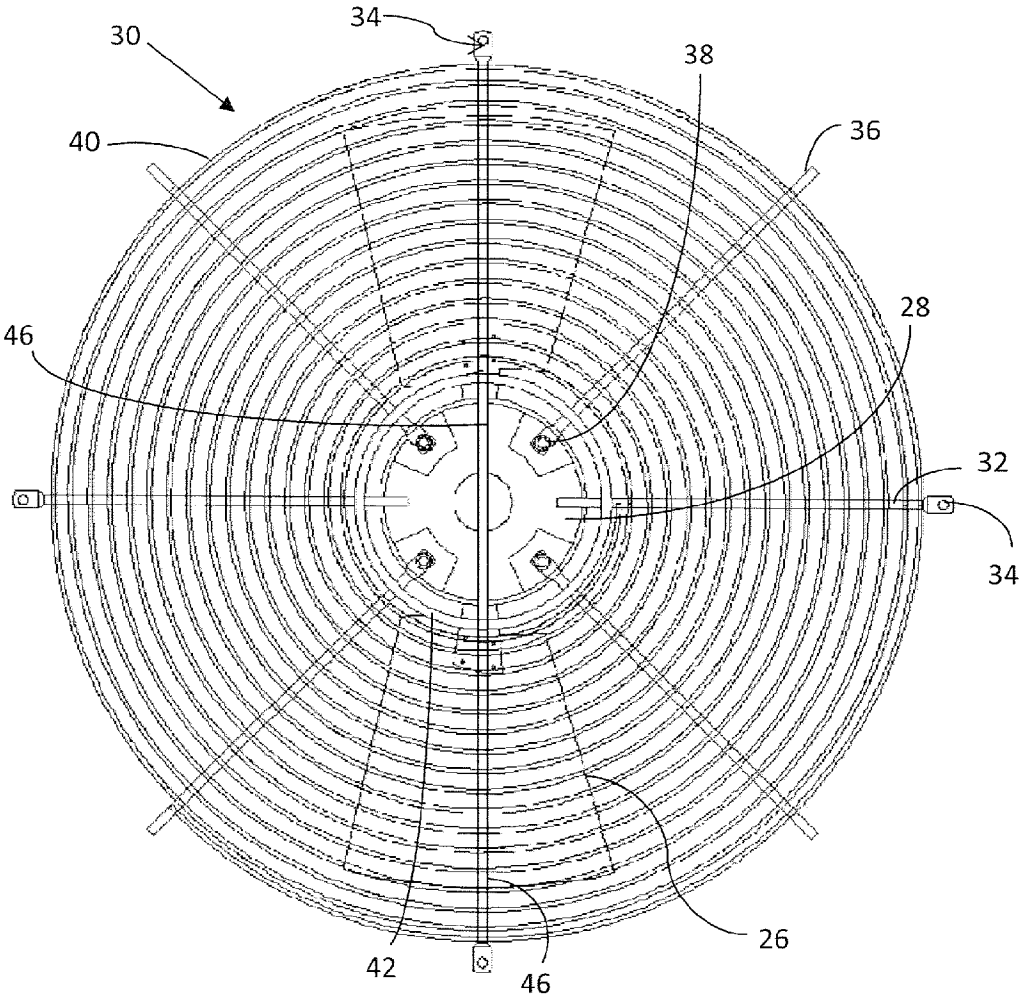
FIG. 2 shows a schematic plan view of the convex spiral fan guard shown in FIG. 1 (having an overall circular shape), illustrating one preferred embodiment of the fan guard of the invention (together with a fan motor joined thereto).

With reference now to FIGS. 2 and 3, a circular shaped fan guard is shown, but it will evident to those skilled in the art that the guard may also have a more squared or rectangular shape, with the same elements shown therein. See for example FIGS. 6 to 9. (where the spacing between the windings being exaggerated for clarity of illustration). The guard 30 is formed by a plurality of first elements 32, preferably made of steel wire and radially oriented which at their peripheral end (opposite to the center of the guard) have a flattened portion where a perforation is made to form an orifice 34 to use to secure the guard to cabinet 12 by means of any suitable fasteners or screws.

The guard 30 also has a plurality of second elements 36, also preferably made of steel wire and radially oriented but at their inner end (closest to the center of the guard) have a flattened portion with a perforation forming an orifice 38 to use for securing the motor 28 to the guard 30 by means of suitable fasteners or screws. Preferably, the flattened portion of radial elements 32 and 36 is made by mechanical deformation of the steel wire.

Figure 5:
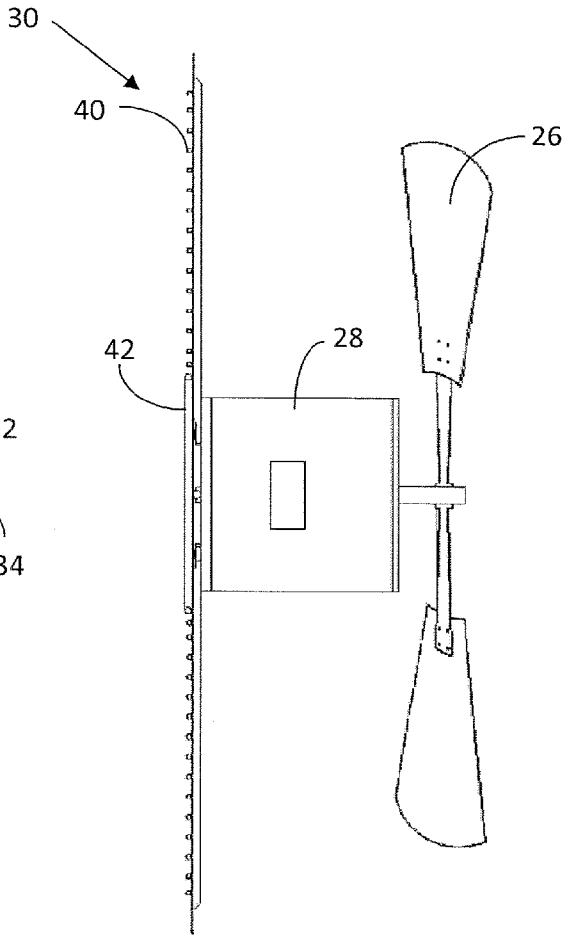
FIG. 5 shows a schematic lateral view of the fan guard and motor shown in FIG. 4.
Figure 4:
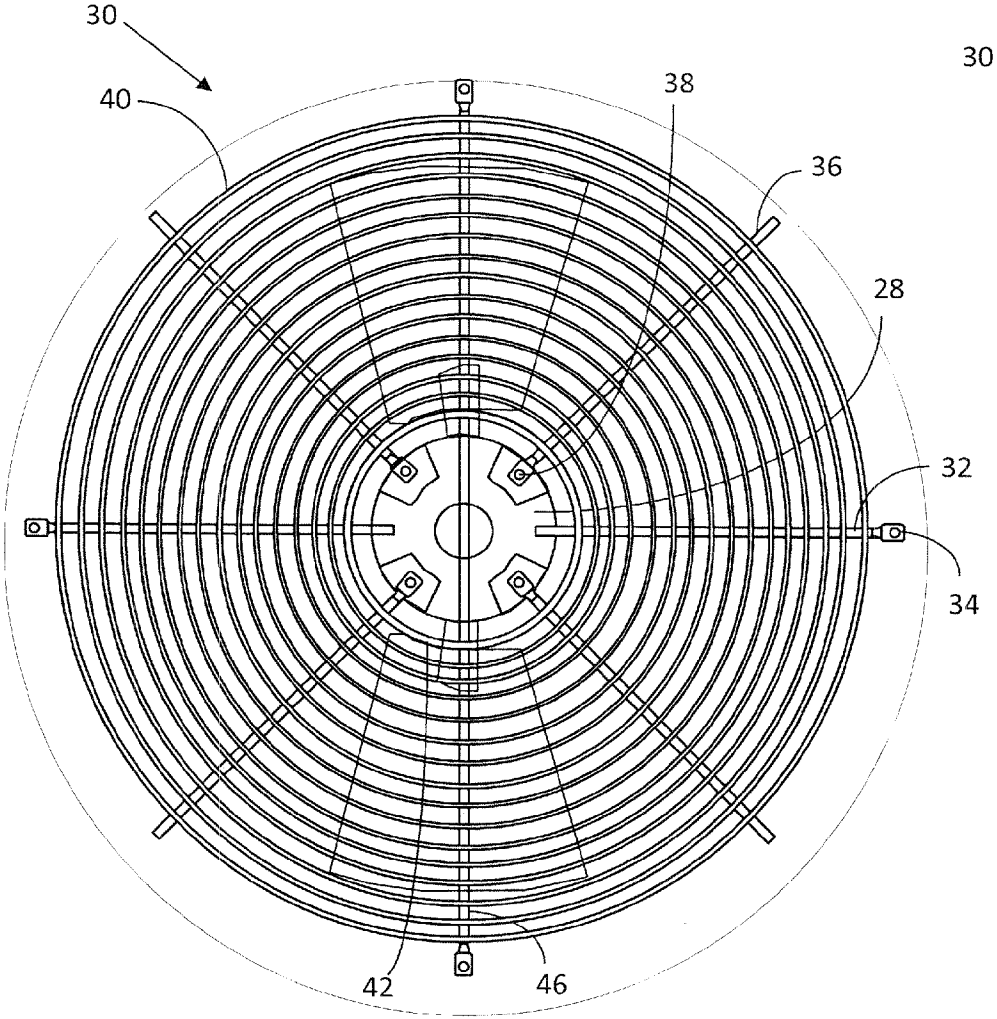
FIG. 4 shows a schematic plan view of a flat concentric-ring fan guard according to another embodiment of the invention (together with a fan motor joined thereto).
Figure 7:
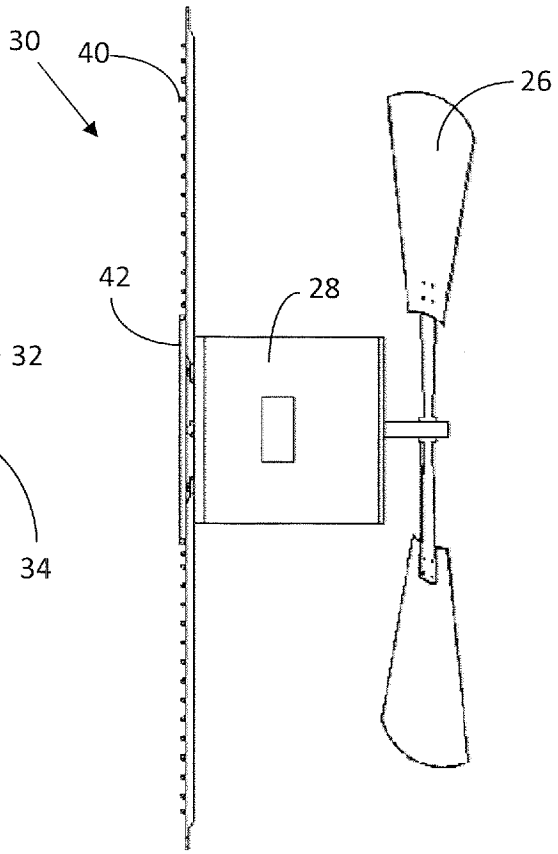
FIG. 7 shows a schematic lateral view of the fan guard and motor shown in FIG. 6.
Figure 6:
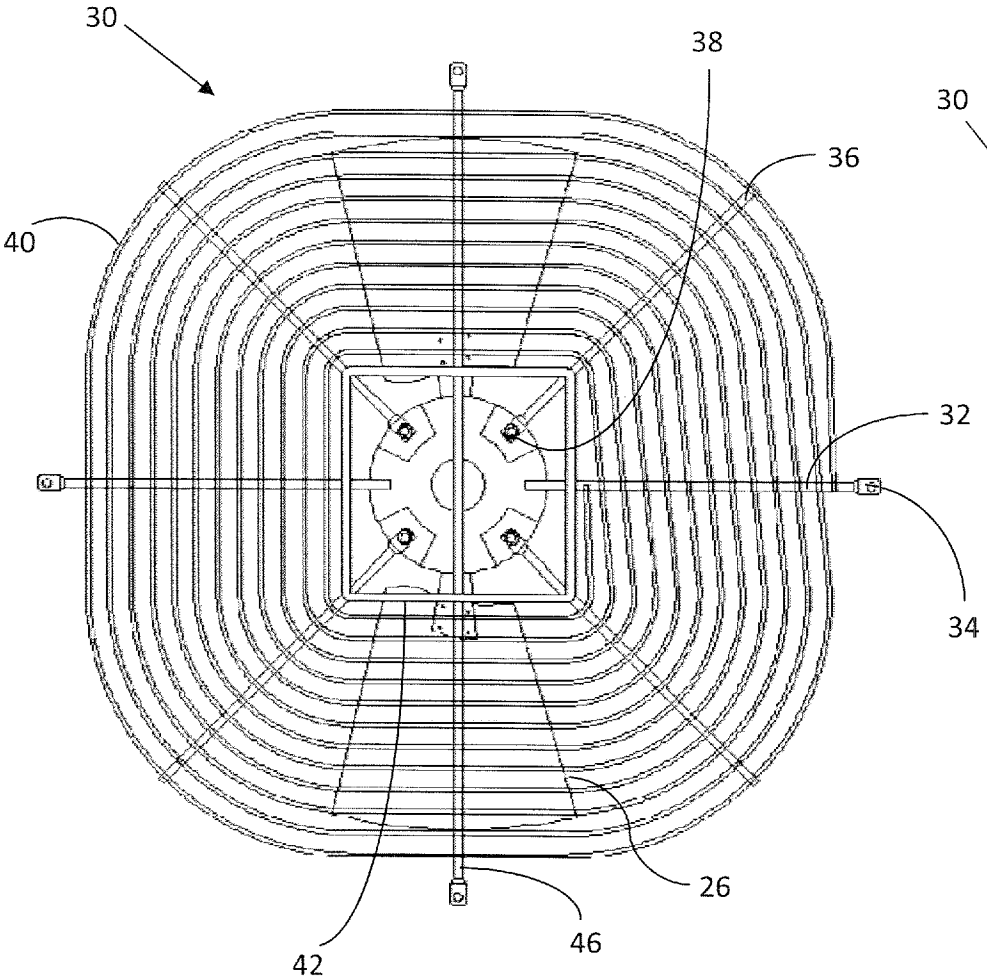
FIG. 6 shows a schematic plan view of a flat square-spiral fan guard according to still another embodiment of the invention (together with a fan motor joined thereto).
Figure 9:
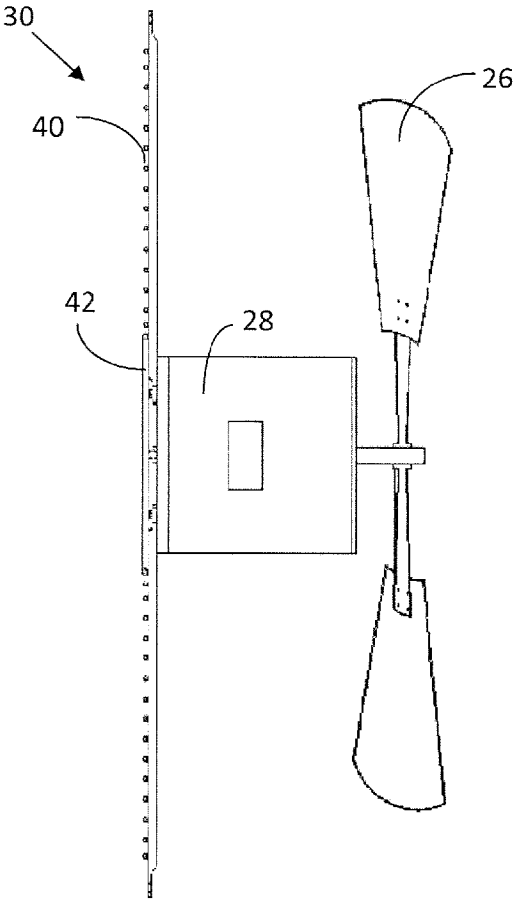
FIG. 9 shows a schematic lateral view of the fan guard and motor shown in FIG. 8.
Figure 8:
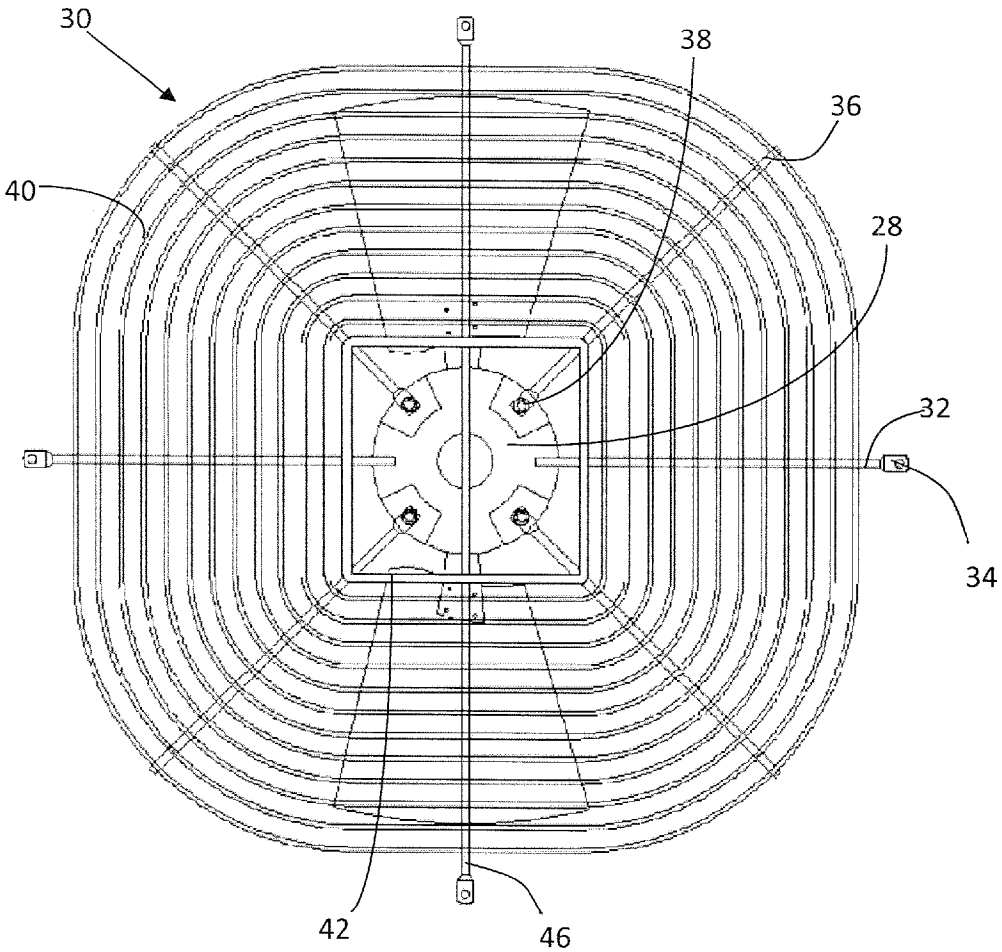
FIG. 8 shows a schematic plan view of a flat concentric square-ring fan guard according to yet another embodiment of the invention (together with a fan motor joined thereto).

In the preferred circular grille embodiments of the invention, elements 32 and 36 are structurally identical (including the flattened portions with a perforation forming an orifice 34 or 38 also being identical). This is particularly true of the flat grille embodiments of FIGS. 4 & 5.

However, in the convex grille embodiments such as in FIGS. 1-3, there is a bend 44 or 44' added to each respectively. More particularly, in each rod element 32 the bend 44 is at a given distance from is orifice 34, while in rod elements 36 the bend 44' is at the same distance, but instead is measured from the end opposite from its orifice 38. Note that if orifices 34 & 38 are made at both ends of elements 32 & 36 (even though only one of the two orifices likely will be used), then even after bending all the elements would be identical. This would be true, if the elements were made with a continuous curvature, rather than a single bend.

In the non-circular grille embodiments of the invention (see for example FIGS. 6-9), the elements 32 and 36 are the same, except possibly for being of different lengths, especially if of a rectangular, rather than largely square, shape.

In order to improve the mechanical strength of the guard, a central ring 42 is welded to the radial elements 32 and 36. This ring 42 provides a greater rigidity and mechanical strength to the guard 30 (without the need for a metal plate). In a preferred embodiment of the invention, the ring 42 may be made of steel wire having a thickness greater than the thickness of the other wire elements of the guard 30. Preferably, the elements 32 and 36 are rods that each have a bend 44 or 44' (or even a continuous bow) such that the guard 30 acquires a concave or convex shape which helps to increase the mechanical strength of the guard and therefore allows use of less thick steel wire for the other elements, thus providing additional economic advantages due to significant savings in the corresponding materials and fabrication costs.

In a preferred embodiment of the invention, the guard comprises two first elements 32, four second elements 36, and one third element 46; but it will be evident to those persons skilled in the art that the number of radial elements may be changed if the thickness of said elements is varied to provide about the same mechanical strength of the guard.

At least one such third element 46 is also provided to extend across the central portion of the guard, substituting for two of the first elements 32 and using the perforation orifices 34 and fasteners to provide greater mechanical strength for supporting the weight of motor 28 and other forces caused by the rotation of the fan 26.

The guard 30 is formed by a plurality of barrier elements shaped as closely-spaced side-by side windings in the form of concentric rings or of a spiral 40 having a separation in accordance with the applicable safety standards for this type of guards to form a safety grille and is preferably formed of steel wire. In a preferred embodiment of the invention, the guard 30 is made from a single steel wire conformed in spiral shape and welded to the radial elements 32, 36 and 46. Although the guard can also be made of concentric wire rings, the spiral form is easier to fabricate.

Preferably, the elements 32, 36, and 46 are circumferentially spaced apart around the fan guard essentially equidistant one from the next with no two adjacent elements being the same and every other element is a second element (which condition is illustrated in the attached drawings, where for example each second element 36 is circumferentially adjacent to either a first element 32 or a third element 46 and each first element 32 or third element 46 is always adjacent to a second element 36).

Figure 10:
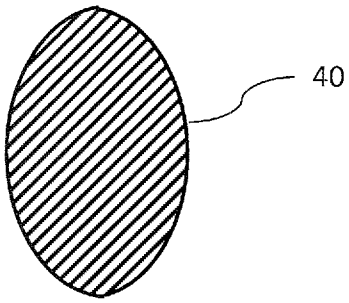
FIG. 10 shows a schematic sectional view of a preferred form of the elements forming the fan guard to offer a lower resistance to the air flow across said guard.

It has been found that the resistance to the flow of air through the guard is significantly decreased if the cross section of the steel wire, which is usually circular in cross section, is modified to an elongated shape having its major dimension oriented parallel to the direction of the air flow. Preferably, the elements 32, 36, 40, and 46 an ovoid shape, similar to that shown in FIG. 10. Other cross-section shapes also decrease the resistance to the air flow, but it has been found that the steel wire may be given an ovoid more easily, thus decreasing the fabrication costs of the fan guard.

The ovoid shape therefore also provides economic advantages to the manufacturers of air conditioning machines since the motors used for the fans may be of a lower capacity for obtaining the same flow of air, which also decreases the operating costs of the air conditioning machines.

Preferably, the guard is made of steel wire covered by a plastic coating which adds a protection against corrosion and contributes to the esthetic look of the fan guard.

It will be understood that only some preferred embodiments of the invention have been herein described and that many changes may be made to a particular embodiment of the invention as it best adapts for a particular use without departing from the spirit and scope of the invention, which is defined in the appended claims.

What is claimed is:

1. A fan guard for an air conditioning machine comprising a cabinet having openings through which air can flow to the inside space of said cabinet for transferring heat between said air and a fluid circulating through a pipe located inside said cabinet, wherein said air flow is induced by means of a motor driving a fan, which induces the air towards an outlet of said cabinet and wherein said guard adapted to be fixed to said cabinet over said outlet with said motor with fan being supported by said guard; characterized by said guard comprising a plurality of first elongated elements converging radially to the center portion of said guard having at each of their outermost ends, with respect to said center portion, a peripheral orifice for securing the guard to said cabinet; a plurality of second elongated elements converging radially to said center portion of said guard having at each of their innermost ends, closest to said center portion, an inner orifice for securing said motor to said guard; a plurality of barrier elements shaped as closely-spaced windings attached to at least said first and second elements to form said guard; a third elongated element extended radially entirely across said guard having at each of its ends, an orifice for securing the guard to said cabinet and a central ring-shaped element attached to said first and second elements and located proximate to said center portion of said guard and said inner orifices to provide mechanical strength to the guard for when said motor is attached to said guard.

2. A fan guard according to claim 1, further comprising said guard has a generally circular shape.

3. A fan guard according to claim 2, further comprising said windings are formed by at least one elongated element shaped as a circular spiral.

4. A fan guard according to claim 2, further comprising said windings are formed by a plurality of elements shaped as concentric circles.

5. A fan guard according to claim 1, further comprising said guard has a generally rectangular shape.

6. A fan guard according to claim 5, further comprising said windings are formed by at least one elongated element shaped as a rectangular spiral.

7. A fan guard according to claim 5 further comprising said windings are formed by a plurality of elements shaped as concentric rectangles.

8. A fan guard according to claim 1, further comprising said elements constituting the guard are made of steel wire.

9. A fan guard according to claim 8, further comprising the elements constituting the guard are made of steel wire covered by a plastic coating.

10. A fan guard according to claim 1, further comprising said first and second elements have a bend so that the guard takes a concave or convex shape to provide it with a higher mechanical strength.

11. A fan guard according to claim 1, further comprising said first and second elements are substantially linear so that said guard takes a flat shape.

12. A fan guard according to claim 1, further comprising a ring-shaped central element is made of steel wire having a greater thickness than the other elements constituting said guard.

13. A fan guard according to claim 1, further comprising said first and second elements have a greater thickness than the windings forming the guard.

14. A fan guard according to claim 8, further comprising said orifices in said first and second elements being located in a flattened portion at the ends of said first and second elements.

15. A fan guard according to claim 14, further comprising said elements constituting said guard being attached to each other by means of welding.

16. A fan guard according to claim 1, further comprising said elements constituting said guard have a cross section having an elongated shape and that said elements are oriented so that the longer dimension of said cross section is substantially parallel to the direction of the air flow.

17. A fan guard according to claim 16, further comprising the elements forming the guard have a cross section area in the form of an ovoid and that said elements are oriented so that the longer dimension of said cross section is substantially parallel to the direction of the air flow.

18. A fan guard according to claim 2, further comprising said elements constituting the guard are made of steel wire; said first and second elements have at least a bend so that the guard takes a concave or convex shape to provide it with a higher mechanical strength; said orifices in said first and second elements being located in a flattened portion at the ends of said first and second elements; said elements constituting said guard being attached to each other by means of welding; and said elements constituting said guard have a cross section having an elongated shape and that said elements are oriented so that the longer dimension of said cross section is substantially parallel to the direction of the air flow.

19. A fan guard according to claim 18, further comprising a ring-shaped central element is made of steel wire having a greater thickness than the other elements constituting said guard.

20. A fan guard according to claim 2, wherein each second element circumferentially alternates with either a first or a third element therefrom whereby no two second elements are adjacent to each other.

* * * * *